US005422540A

United States Patent [19]

Suzuki

[11] Patent Number: 5,422,540

[45] Date of Patent: Jun. 6, 1995

[54] HIGH POWER KLYSTRON TUNING MECHANISM HAVING MEANS FOR DETECTING NON-SYNCHRONOUS TUNING CHANNEL CONDITIONS

[75] Inventor: Wakou Suzuki, Tokyo, Japan

[73] Assignee: NEC Corporation, Japan

[21] Appl. No.: 9,813

[22] Filed: Jan. 27, 1993

[30] Foreign Application Priority Data

Jan. 30, 1992 [JP] Japan ..... 4-040369
Mar. 4, 1992 [JP] Japan ..... 4-046498

[51] Int. Cl.[6] ..... H01J 23/20

[52] U.S. Cl. ..... 315/5.47; 315/5.48; 315/5.53; 315/5.54

[58] Field of Search ..... 315/5.46, 5.47, 5.48, 315/5.53, 5.54; 331/83

[56] References Cited

U.S. PATENT DOCUMENTS 4,216,409 8/1980 Sato et al. ..... 315/5.46
4,908,549 3/1990 Bres et al. ..... 315/5.46 X
5,281,895 1/1994 Suzuki et al. ..... 315/5.47

*Primary Examiner*—Benny T. Lee
*Attorney, Agent, or Firm*—Laff, Whitesel, Conte & Saret, Ltd.

[57] ABSTRACT

A high power klystron turning mechanism identifies which tuning channel has been set. A plurality of tuners are inserted into individually associated cavity resonators. A tuner supporting mechanism includes a plurality of screws which protrude to force the tuners predetermined distances into the cavity resonators. A detector detects the position of the tuner support mechanism, and therefore how far the protruding screw structure has forced a tuner into the cavity resonators, which, in turn, indicates the tuning. The detector comprises a preset plate which selectively operates a plurality of switches at locations corresponding to the protruded screws and at another location in order to generate a more accurate tuning identification. The detector may be either a light-photo cell combination or mechanical switches.

4 Claims, 7 Drawing Sheets

HIGH POWER KLYSTRON TUNING MECHANISM HAVING MEANS FOR DETECTING NON-SYNCHRONOUS TUNING CHANNEL CONDITIONS

BACKGROUND OF THE INVENTION

1. Field of the Invention

The present invention relates to a klystron tuning mechanism, and more specifically to a high power klystron tuning mechanism for altering the high frequency power.

2. Description of the Prior Art

A high power klystron includes an electron gun for releasing electrons therefrom and thereby forming an electron beam, a RF section for interaction between the electron beam and the high frequency power, a collector for collecting the electrons, and a focusing unit for focusing the electron beam. The RF section includes cavity resonators, tuners for varying resonance frequencies of the cavity resonators, respectively, and a tuning mechanism for connecting and supporting the tuners. In case the high frequency power to be amplified is desired to be varied, it is necessary in the high power klystron to adjust a plurality of resonance frequencies of the cavity resonators to proper ones while observing frequency characteristics thereof on all such occasions. This causes inconvenience in its handling and operation as, compared with a travelling tube which is to amplify microwaves like the foregoing high power klystron.

To eliminate such inconvenience in the operation there is available a high power klystron including a tuning function which possesses a preset function in which it becomes possible at a previously set specific frequency to obtain easily a predetermined band width by carrying out only channel switching operation without performing any additional adjustment work. A prior art high power klystron including such a preset function as described above is arranged as illustrated in FIG. 1 for example. More specifically, the RF section of the high power klystron comprises a plurality of cavity resonators 1, tuners 2 of the same number as that of the cavity resonators wherein the cavity resonators 1 are varied in their volumes to change their resonance frequencies, and bellows 3 connected to the tuners 2 and the cavity resonators 1, respectively, for enabling the tuners 2 to go into and out (slide) the cavity resonators 1 by their mechanical deformation while keeping a vacuum in the high power klystron.

A tuning mechanism 4, which is connected to the tuners 2 each serving as described above to alter the resonance frequencies of the cavity resonators 1, comprises a tuner supporting mechanism 5 for exerting on the tuners 2 a biasing force in the opposite direction to the side of a vacuum tube of the high power klystron along the shafts of the tuners 2 at all times with the aid of restoring force of springs 8, a preset part 7 including means for moving parts on a preset plate 10 in parallel in response to a rotation of a pinion 11, the preset plate 10 being fixedly mounted on the RF section through the supporters 6 and allowing a plurality of sets of frequency setting screws 9 to be attached thereto, a tuning channel detector part 25 (refer to FIG. 2B) for detecting the fact that which frequency setting screw 9 is connected to the tuner 2, and a driving mechanism 13 for rendering a connection or a disconnection between the frequency setting screw 9 and the tuner shaft 12.

Herein, designated at 14 are bearings, 15 is a fixed plate, 16 is a locking shaft, 17 is a movable plate, 18 is a unlocking plate, 19 is a frequency alteration shaft, and 20 are locking plates.

Referring to FIGS. 2A and 2B, the tuning channel detector part 25 is illustrated in detail. In the lower part of the preset plate, 10, slits 21 are provided at locations corresponding to the frequency setting screws 9 (FIG. 2A). In order to permit the transmission of light through these slits 21, four successive photointerrupters 22 (each photointerrupter 22 comprises a light emitting diode 23 and a photodiode 24 as seen in FIG. 2B) are mounted on the preset plate 10 at the same pitch or interval as in the frequency setting screws 9. The photodiode 24 becomes conductive as light emanating from the light emitting diode 23 of the photointerrupter 22 reaches the photodiode 24 after passage through the slit 21, whilst the same photodiode 24 becomes non-conductive as the same light is interrupted. The slits 21 are disposed such that signals detected by the tuning channel detector part 25 are as listed in TABLE 1 for respective channels with the assumption of the conductive and non-conductive states of the photodiode 24 set to be 1 and 0.

TABLE 1

| Tuning Channels | Signals Detected by Tuning Channel Detector Part | | | |
|---|---|---|---|---|
| 1 | 1 | 0 | 1 | 1 |
| 2 | 0 | 1 | 1 | 0 |
| 3 | 1 | 1 | 0 | 1 |
| 4 | 1 | 0 | 1 | 0 |
| 5 | 0 | 1 | 0 | 0 |
| 6 | 1 | 0 | 0 | 0 |

More specifically, with the arrangement illustrated in FIG. 2A (in the case of the tuning channel 1 in TABLE 1) a signal of 1011 is generated, and likewise once another frequency setting screw 9 is connected with the tuner 2 constituting part of the cavity resonator 1 by moving the preset plate 10, a signal corresponding to an associated tuning channel is generated from the tuning channel detector part 25. On the basis of the detected signal, it becomes possible to judge the fact that the associated klystron is set to which tuning channel.

A preset operation in the tuning mechanism, in which operation a predetermined band width is previously set for one tuning channel of the high power klystron through a set of the frequency setting screws 9 disposed along a drift tube of the cavity resonator, is performed as follows: First, an adjustment is performed with the aid of the frequency setting screws 9 such that the band width of the predetermined channel is yielded in the state of FIG. 1. In succession, the locking shaft 16 fixed through the bearing 14 to the fixing plate 15. The shaft is turned until the movable plate 17 makes contact with the unlocking plate 18. At this time, contacts between the tuner shafts 12 connected to the tuners 2 become disconnected. In this state, the frequency alteration shaft 19 is rotated to bring another frequency setting screw 9 into coincidence with the central axis of the timer shaft 12. At this location, the movable plate 17 is again moved until the movable plate strikes the locking plate 20 through the locking shaft 12. In this state, the degree of a projecting length of the frequency setting screw 9 is adjusted such that a predetermined band width characteristic is ensured in another tuning channel which is different from the foregoing tuning channel. With repetition of such adjustment a plurality of tuning channels of the high power klystron can be set previously.

In the tuning mechanism described above, any tuning channel is specified by a plurality of the slits 21 as illustrated in FIG. 2A, so that it is impossible to quickly and completely make the slits 21 and the photointerrupters 22 coincident with each other positionally, resulting in a difficulty of generated signals being slightly shifted in time. Accordingly, there might sometimes occur an inconvenience that upon alteration of a tuning channel, a signal of another tuning channel is sent from the tuning channel detector part. More specifically, an error might be produced in the signals detected by the tuning channel detection part listed in TABLE 1 that signals of other tuning channels are detected among the respective channels as listed in TABLE 2. Namely, there might be produced a possibility that erroneous detected signals with a pattern of TABLE 2 (signals indicated in parentheses) are issued.

TABLE 2

| Tuning Channels | Signals Detected by Tuning Channel Detector Part |
|---|---|
| 6,4 | 1000 (0011, 1001, 0010, 0001), 1010 |
| 1 | 1011 |
| 6,5,4 | 1000 (00011, 1001, 0010, 0001), 0100, 1010 |
| 2 | 0110 |
| 6,5 | 1000, (0010), 1000 |
| 3 | 1101 |
| 6,5 | 1000, (0010), 0100 |
| 4 | 1010 |
| 6 | 1000, (0010) |
| 5 | 0100 |
| 6 | 1000 |

Channel alteration is thus recognized to have been completed at an incorrect location upon the alteration of a tuning channel, which impedes alteration to a tuning channel to be used.

SUMMARY OF THE INVENTION

To solve the problems with the prior art, it is an object of the present invention to provide a high power klystron tuning mechanism in which a correct judgment on a tuning channel can securely be performed.

To achieve the above object, there is provided in a first aspect of the present invention a high power klystron tuning mechanism, said tuning mechanism comprising: a plurality of cavity resonators constituting together part of a vacuum tube of a high power klystron and each disposed at a predetermined pitch.; a plurality of tuners each adapted to be insertable into the-cavity resonators; a tuner supporting mechanism connected with the tuners for excerting a force on the tuners at all times in the opposite direction to the side of the vacuum tube; a preset plate making contact with at least part of the tuner supporting mechanism and serving to integrally support a plurality of protruded structures each of which forces the tuners into the cavity resonators at the same pitch as that of the cavity resonators; a driving mechanism including means for making a connection or a disconnection between each of the protruded structures of the preset plate and each of the tuners corresponding to the protruded structures; and a detector part for detecting which protruded structure among the plurality of the protruded structures of the preset plate is connected with a tuner corresponding thereto, wherein part of each the protruded structure is previously set to protrude through the driving mechanism and the preset plate is driven to slide intermittently at the same pitch as the pitch of arrangement of the cavity resonators in the direction of the arrangement of the cavity resonators whereby the tuners are inserted into the cavity resonators in conformity with a previously set tuning channel pattern, the improvement being such that the detector part comprises: a part to be detected possessing gaps such as slits and holes formed in part of .the preset plate so as to correspond to the previously set protruded structures; a plurality of switches, almost all thereof fixedly mounted at locations corresponding to the protruded structures and part thereof fixedly mounted at locations shifted from the corresponding locations of the protruded structures, for detecting locations of the gaps formed in the part to be detected; and detector means for detecting which tuning channel among the previously set tuning channels has been set, on the basis of signals detected by the switches.

Further, there is provided in a second aspect of the present invention a high power klystron tuning mechanism as set forth in the foregoing first aspect, wherein there is disposed at least one opening part at locations not in synchronism with the respective locations of the respective protruded structures of the preset plate and at locations where the switches are operable.

There is further provided a high power klystron tuning mechanism as set forth in any one of the foregoing aspects, wherein each of the switches is a photointerrupter composed of a light emitting diode and a photodiode.

There is still further provided a high power klystron as set forth in any one of the foregoing aspects, wherein all of the plurality of the switches are contact type switches.

There is still yet further provided a high power klystron tuning mechanism as .set forth in any one of the foregoing aspects, wherein the switches fixedly mounted at the locations corresponding to the gaps formed in the part to be detected among the plurality of the switches are photointerrupters, each photointerrupter being composed of a light emitting diode and a photodiode, and wherein the switches fixedly mounted at locations not corresponding to the gaps are contact type switches.

In accordance with the present invention, the gaps such as slits and holes are formed at locations corresponding to the protruded structures which were previously set in part of the preset plate, and almost all switches for detecting the gaps are fixedly mounted at the locations corresponding to the protruded structures while the other switches are fixedly mounted at the locations shifted from the locations corresponding to the protruded structures. The identity of the tuned channel is detected on the basis of output signals from the detector switches. This improves detection accuracy of the tuning channel.

Further, in accordance with the present invention the opening part is disposed at the location not in synchronism with the frequency setting screw whereby a mistaken tuning channel is prevented from being set upon any tuning channel being altered.

The above and many other advantages, features and additional objects of the present invention will become manifest to those versed in the prior art upon making reference to the following detailed description and accompanying drawings in which preferred structural embodiments incorporating the principles of the present invention are shown by way of illustrative example.

DETAILED DESCRIPTION OF THE PREFERRED EMBODIMENTS

In what follows, there will be described the present invention further in detail in association with some preferred embodiments illustrated the attached drawings (FIGS. 3A through 7B).

Figure 1:
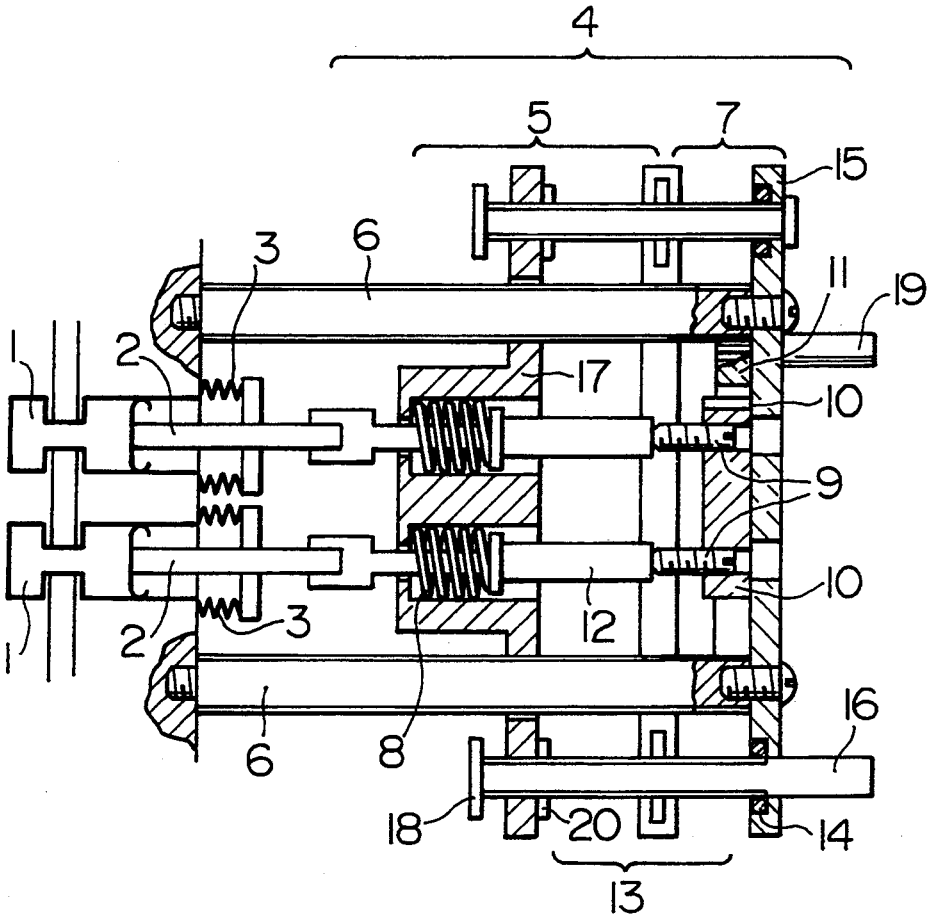
FIG. 1 PRIOR ART
FIG. 1 is a schematical sectional-view illustrating the structure of a prior art klystron tuning mechanism.
Figure 2A:
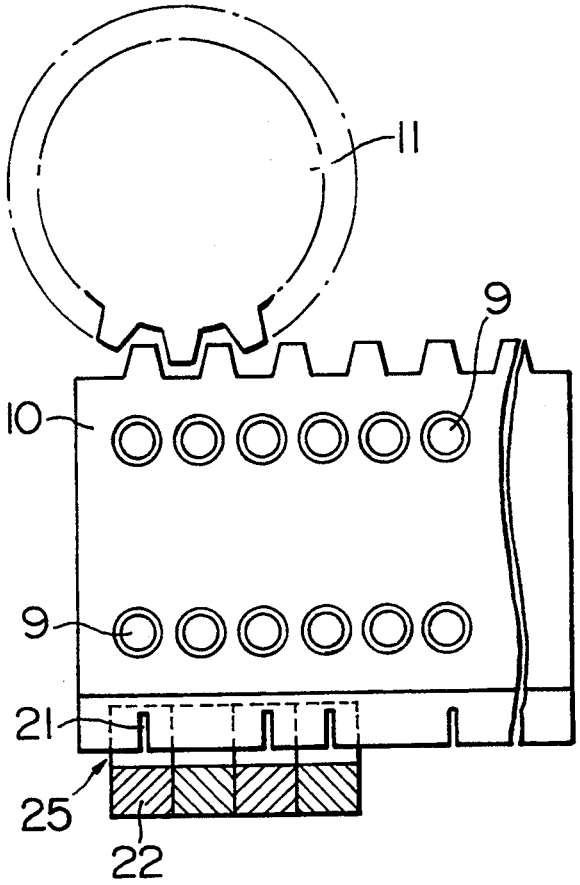
FIG. 2A PRIOR ART
FIGS. 2A and 2B are front and side views each illustrating the construction of a portion of the prior art klystron tuning mechanism.
Figure 2B:
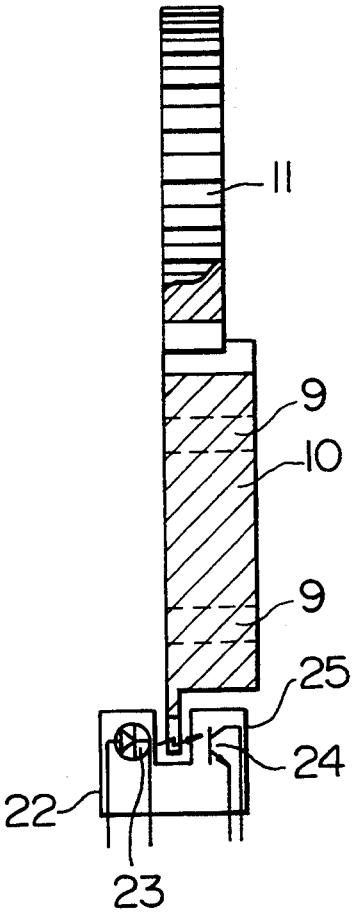
FIG. 2B PRIOR ART
Figure 3A:
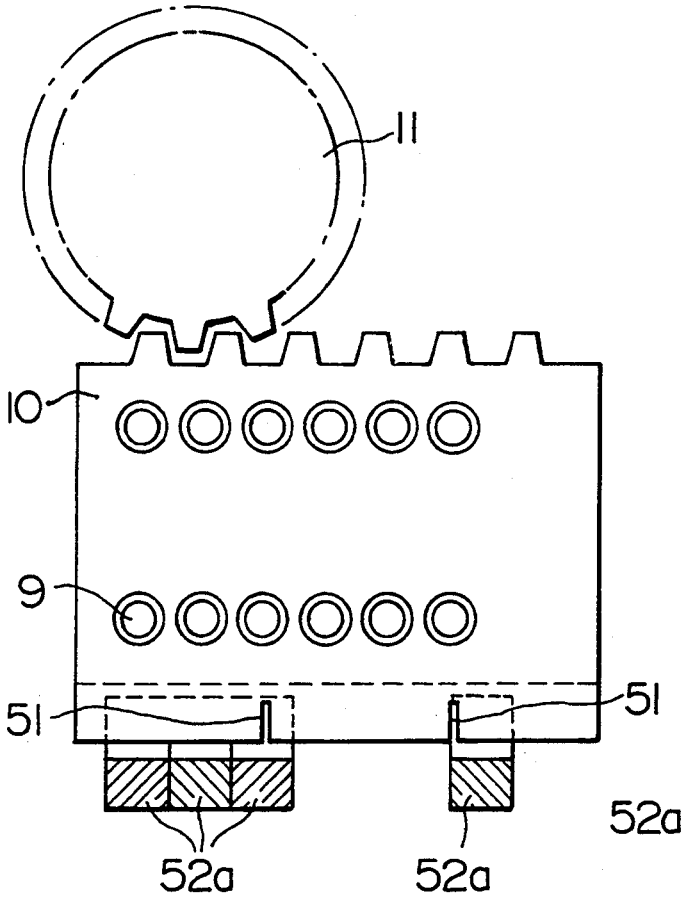
FIGS. 3A and 3B are front and side views each illustrating the construction of a portion of a klystron tuning mechanism according to a first embodiment of the present invention.
Figure 3B:
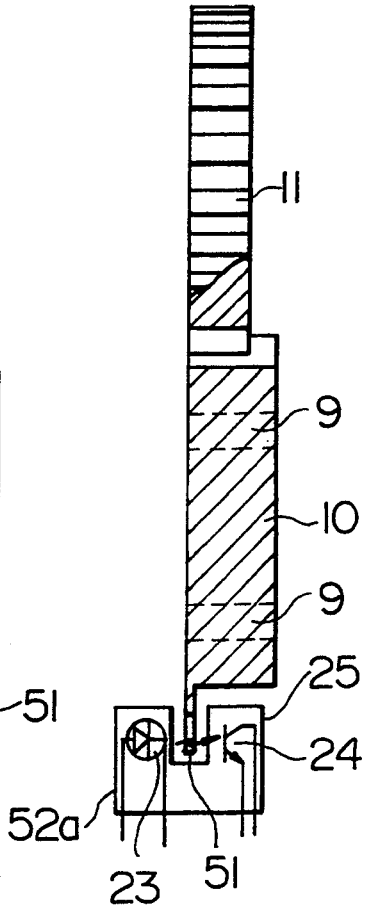

Referring to FIGS. 3A and 3B, a construction is illustrated of a portion of a klystron tuning mechanism according to the first embodiment of the present invention. For elimination of overlapping, like symbols shall be applied to like portions as those of the prior art cases (FIGS. 2A and 2B), and the description thereof will be omitted and only different portions will be described in detail (to the other embodiments the same shall also be applied).

In a klystron tuning mechanism illustrated in FIGS, 3A and 3B, two slits 51, 51 are formed in the lower part of a preset plate 10. Three successive photointerrupters 52*a* are fixedly mounted on the left end of the preset plate 10 and a photointerrupter 52*a* is fixedly mounted at an intermediate location between tuning channels 3 and 4, i.e., not corresponding to any channel; please see TABLE 3 for a better understanding thereof.

Referring to TABLE 3, there are listed detected signals in the respective tuning channels with the construction of the embodiment described above.

TABLE 3

| Tuning Channel | Detection Signals | | | |
|---|---|---|---|---|
| 1 | 0 | 0 | 1 | 0 |
| 2 | 0 | 1 | 0 | 0 |
| 3 | 1 | 0 | 0 | 0 |
| | (0 | 0 | 0 | 1) |
| 4 | 0 | 0 | 1 | 1 |
| | (0 | 0 | 0 | 1) |
| 5 | 0 | 1 | 0 | 1 |
| | (0 | 0 | 0 | 1) |
| 6 | 1 | 0 | 0 | 1 |

In such a manner, in the present embodiment no other channel is formed between tuning channel to be altered, and hence erroneous detection can be avoided.

Figure 4A:
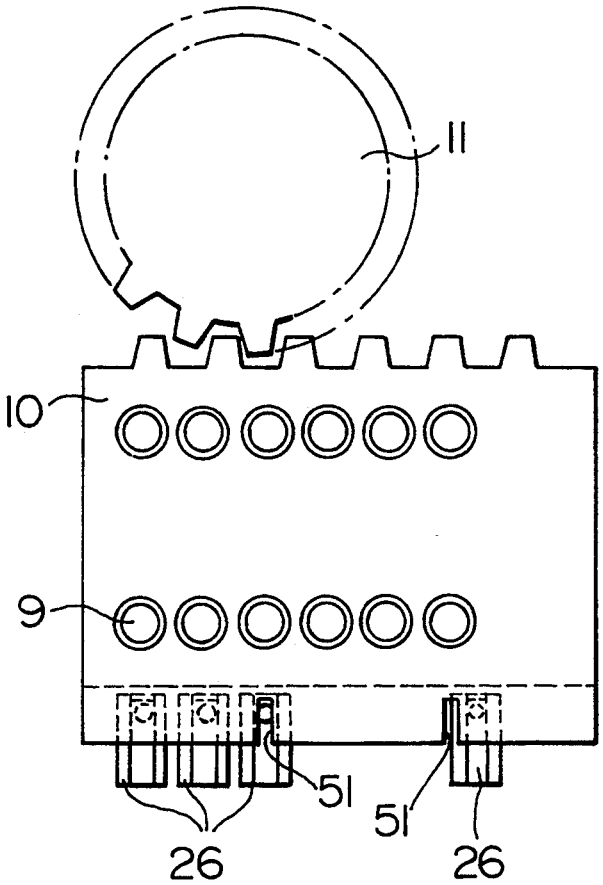
FIGS. 4A and 4B are front and side views each illustrating the construction of a klystron tuning mechanism according to a second embodiment of the present invention.
Figure 4B:
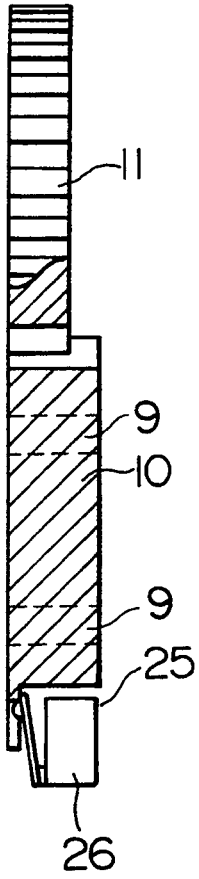

Referring to FIGS. 4A and 4B, there is illustrated the construction of a portion of a klystron tuning mechanism according to the second embodiment of the present invention. In the present embodiment a contact type switch 26 is usable instead of the photointerrupters 52*a* of FIGS. 3A–3B in the first embodiment. Hereby, the tuning mechanism can advantageously be constructed only with a mechanical mechanism.

Figure 5A:
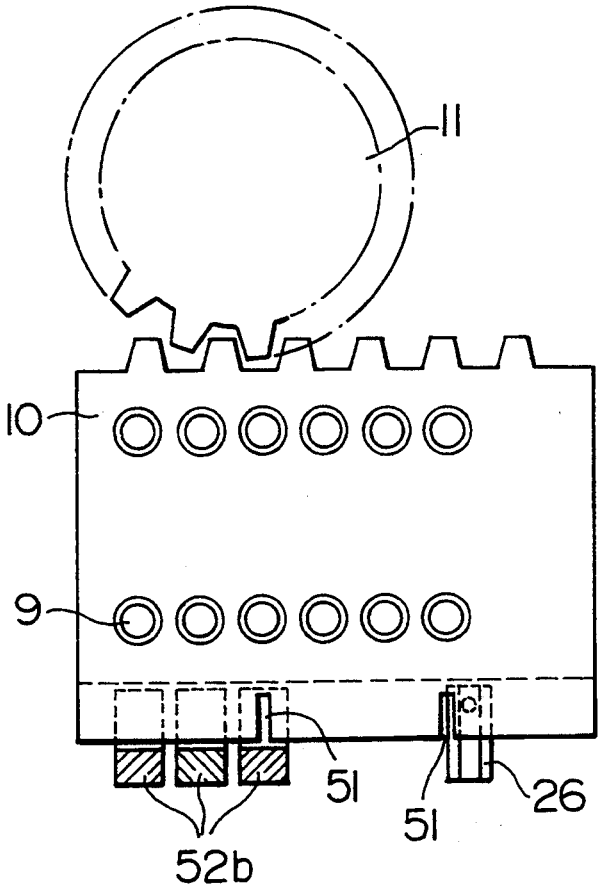
FIGS. 5A and 5B are front and side views each illustrating the construction of a klystron tuning mechanism according to a third embodiment of the present invention.
Figure 5B:
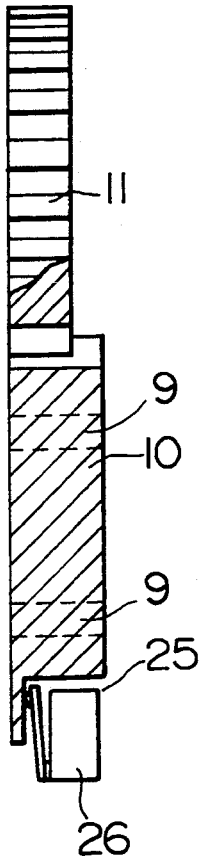

Referring to FIGS. 5A and 5B, there is illustrated the construction of a portion of a klystron tuning mechanism according to the third embodiment of the present invention. The present embodiment is of a combination of the first and second embodiments in which three successive photointerrupters 52*b* (see FIG. 5A) are disposed at the left of the preset plate 10 and a contact type switch 26 is disposed at a location where it becomes conductive between tuning channels 3 and 4.

Figure 6A:
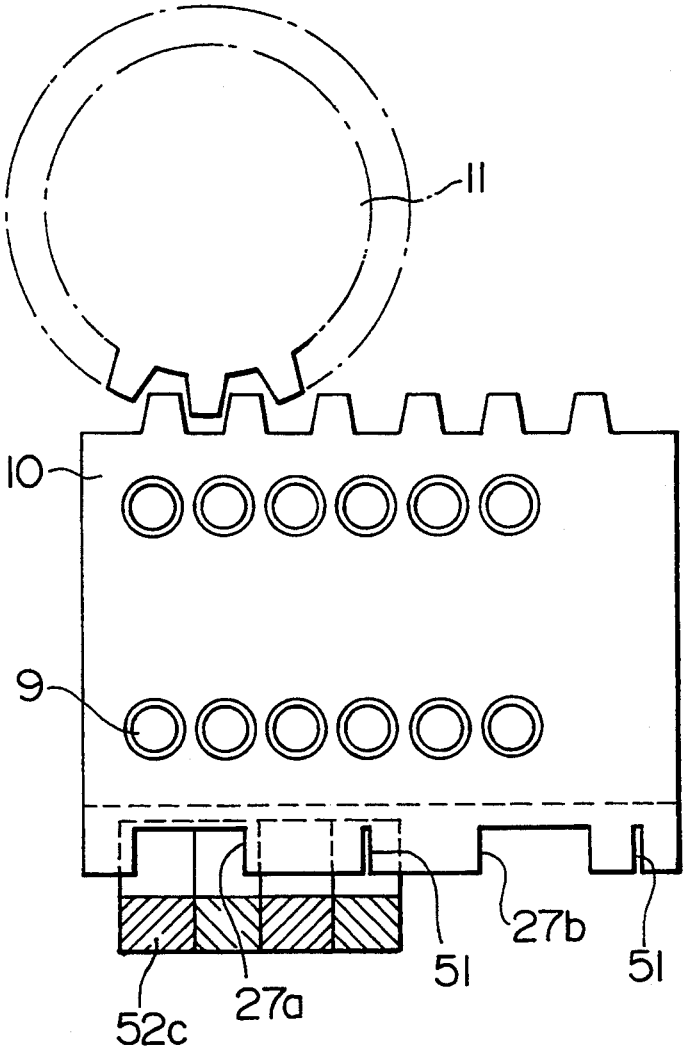
FIGS. 6A and 6B are front and side views each illustrating the construction of a klystron tuning mechanism according to a fourth embodiment of the present invention.
Figure 6B:
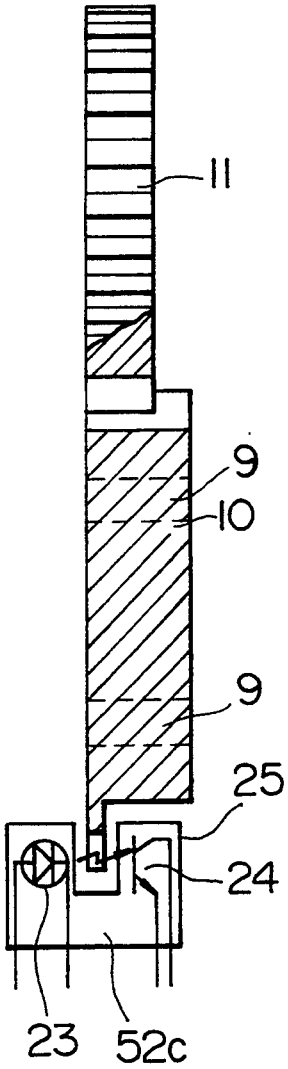

Referring to FIGS. 6A and 6B, there is illustrated in the forms of front and side views a portion including a preset plate 10, a pinion 11, a frequency setting screw 9, and a tuning channel detector part 25 of the high power klystron tuning mechanism according to the fourth embodiment of the present invention. There are provided two slits 51 at locations corresponding to those of the frequency setting screws 9 on the lower part of the preset plate 10 which supports the frequency setting screw 9 being a plurality of protruded structures connected with the tuners constituting part of the high power klystron cavity resonators. Additionally, wider opening parts. 27*a* and 27*b* (FIG. 6A) are provided such that one or two photointerrupters 52*c* becomes or become conductive between tuning channels. Four successive photointerrupters 52*c* are fixedly mounted in the same interval as in the frequency setting screws 9 corresponding to the slit 51 (FIG. 6A) for permission of light transmission.

TABLE 4 lists signals through the respective tuning channel with the assumption of conductive and non-conductive states to be 1 and 0.

TABLE 4

| Tuning Channel | Signals Detected by Tuning Channel Detector Part |
|---|---|
| 1 | 1101 (1100 or 1000) |
| 2 | 1010 (1000 or 0000 or 0001) |
| 3 | 0101 (0001 or 0011) |
| 4 | 1011 (0011 or 0110) |
| 5 | 0111 (0110 or 1100) |
| 6 | 1110 (1100) |

Figure 7A:
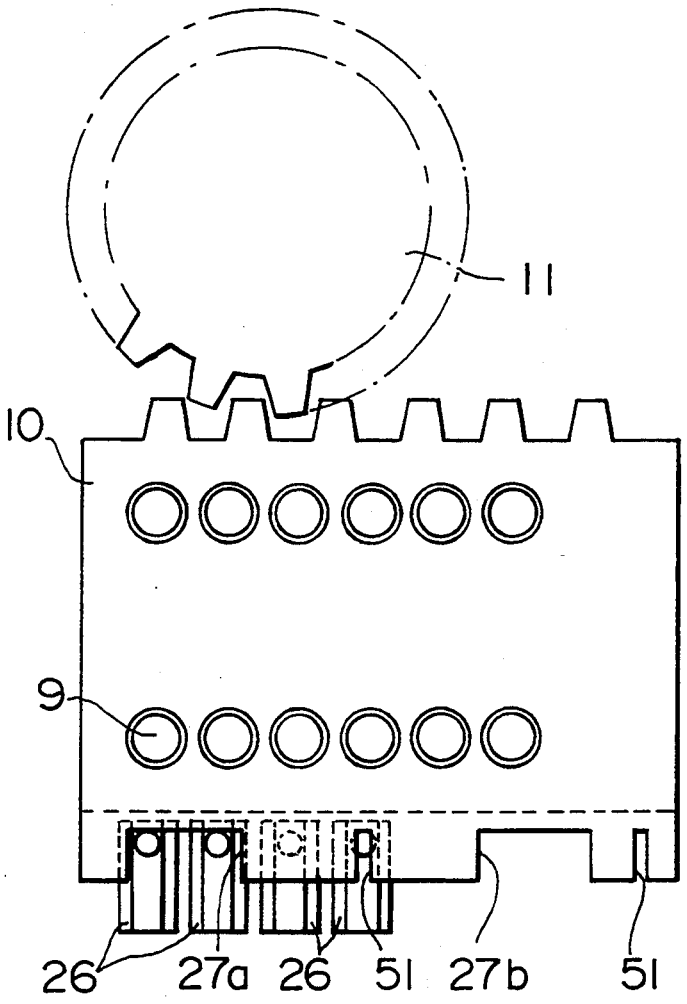
FIGS. 7A and 7B are front and side views each illustrating the construction of a portion of a klystron tuning mechanism according to a fifth embodiment of the present invention.
Figure 7B:
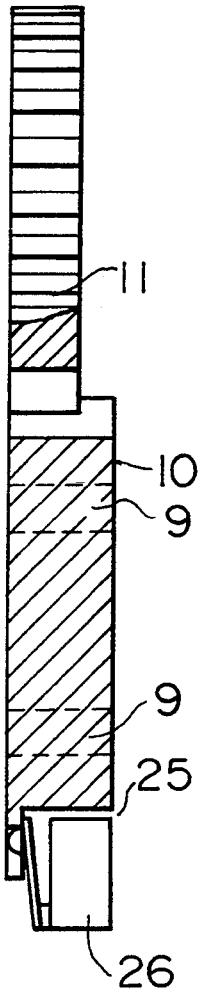

Referring to FIGS. 7A and 7B there are illustrated the fifth embodiment of the present invention in the forms of sectional and side views. The preset plate 10 has its

What is claimed is:

1. A high power klystron tuning mechanism, said tuning mechanism comprising:

a plurality of cavity resonator means constituting a tuning part for a vacuum tube of a high power klystron, each of said cavity resonator means being disposed at a respective predetermined pitch relative to other of said cavity resonator means; a plurality of sliding tuners, each of said tuners being individually associated with a corresponding one of said cavity resonator means; a tuner supporting mechanism connected with said tuners for exerting a force on said tuners at all times, said exerted force being in a direction which is opposite to a direction in which said tuners slide for reducing a space in said cavity resonator means; a preset plate making contact with at least a part of said tuner supporting mechanism and serving to integrally support a plurality of protruded structures, each of said protruded structures forcing individually associated ones of said tuners to slide into corresponding ones of said cavity resonator means to reduce a space therein; a driving mechanism including means for completing a connection or a disconnection between each of said protruded structures of said preset plate and each corresponding one of said tuners; and a detector part for detecting which protruded structure among the plurality of the protruded structures of said preset plate is connected with a tuner corresponding thereto, wherein part of each of said protruded structures is previously set to protrude through said driving mechanism and said preset plate is driven to slide intermittently, said sliding being in a direction corresponding to a direction in which said cavity resonator means extended, whereby said tuners are inserted into said cavity resonator means in conformity with a previously set tuning channel pattern, the improvement being such that said detector part comprises:

a part to be detected possessing gaps disposed in part of said present plate so as to correspond to said protruded structures;

a plurality of switches, almost all thereof fixedly mounted at locations corresponding to said protruded structures and part thereof fixedly mounted at locations shifted from said corresponding locations of the protruded structures, for detecting locations of said gaps disposed in said part to be detected; and detector means for detecting which tuning channel among said previously set tuning channels has been set, on the basis of signals detected by said switches, and at least one opening disposed on said part to be detected and at a location which is not in synchronism with the respective locations of the protruded structures of said preset plate and at a location where said switches are operable in order to give combined signals identifying a channel to which the klystron is tuned.

2. A high power klystron tuning mechanism according to claim 1 wherein said switches are fixedly mounted at locations corresponding to the gaps disposed in said part to be detected among the plurality of the switches are photointerrupters, each photointerrupter being composed of a light emitting diode and a photodiode operatively connected together, and wherein said switches are fixedly mounted at locations which do not correspond to said gaps are contact type switches.

3. A high power klystron tuning mechanism according to claim 1 wherein each of said switches is a photointerrupter means composed of a light emitting diode and a photodiode operatively connected together, said gaps and said opening means passing said light and an absence of said gaps and said opening means blocking said light.

4. A high power klystron tuning mechanism according to claim 1 wherein all of the plurality of the switches are contact type switches.

* * * * *